US009562351B2

(12) United States Patent
Ibrahim et al.

(10) Patent No.: US 9,562,351 B2
(45) Date of Patent: Feb. 7, 2017

(54) ARCHITECTONIC SPACER BUILDING SYSTEM

(75) Inventors: Rahinah Ibrahim, Serdang (MY); Siva Jaganathan, Serdang (MY)

(73) Assignee: Universiti Putra Malaysia, Selangor Darul Ehsan (MY)

( * ) Notice: Subject to any disclaimer, the term of this patent is extended or adjusted under 35 U.S.C. 154(b) by 0 days.

(21) Appl. No.: 13/436,144

(22) Filed: Mar. 30, 2012

(65) Prior Publication Data

US 2012/0304562 A1 Dec. 6, 2012

Related U.S. Application Data

(63) Continuation-in-part of application No. PCT/MY2009/000203, filed on Dec. 4, 2009.

(30) Foreign Application Priority Data

Oct. 1, 2009 (MY) ..... PI 20097019

(51) Int. Cl.
*E04B 1/26* (2006.01)
*E04B 7/02* (2006.01)

(52) U.S. Cl.
CPC ..... *E04B 1/2604* (2013.01); *E04B 7/028* (2013.01); *E04B 2001/262* (2013.01)

(58) Field of Classification Search
CPC ... E04B 1/2604; E04B 2001/262; E04B 7/028
USPC ..... 52/220.1–220.3, 402, 580, 650.1, 655.1, 52/656.1
See application file for complete search history.

(56) References Cited

U.S. PATENT DOCUMENTS

| | | | | | |
|---|---|---|---|---|---|
| 3,008,195 | A * | 11/1961 | Coffey | 52/93.2 |
| 3,683,569 | A * | 8/1972 | Holm | 52/93.1 |
| 4,114,333 | A * | 9/1978 | Jones et al. | 52/265 |
| 5,566,523 | A * | 10/1996 | Ozanne | 52/655.1 |
| 5,572,841 | A * | 11/1996 | Buster | 52/270 |
| 5,927,036 | A * | 7/1999 | Matthews et al. | 52/483.1 |
| 6,145,261 | A * | 11/2000 | Godfrey et al. | 52/302.1 |
| 2005/0284081 | A1* | 12/2005 | Porter | 52/650.1 |
| 2006/0053729 | A1* | 3/2006 | Wallner | 52/655.1 |
| 2006/0112657 | A1* | 6/2006 | Abbot-Wilcox | 52/633 |
| 2007/0004251 | A1* | 1/2007 | McCarthy | 439/82 |
| 2007/0006691 | A1* | 1/2007 | Leek et al. | 81/176.1 |
| 2010/0281784 | A1* | 11/2010 | Leo | 52/16 |

* cited by examiner

*Primary Examiner* — Joshua J Michener
*Assistant Examiner* — Alp Akbasli
(74) *Attorney, Agent, or Firm* — Locke Lord LLP

(57) ABSTRACT

The architectonic spacer building system is a simplified prefabrication assembly using industrialized building system concept. The architectonic spacer building system for skeleton construction includes a spacer (2, 4, 6, 8, 10) having a predetermined shape for use in constructing modular form of building components, including a modular floor joist assembly (18), corner and crisscross junctions assembly (17, 19). The spacer acts as an anchored dowel connector (2, 10), composite key roof connector (22, 24, 26) and/or a bracing (2, 4, 6, 8) of adjoining wall panel (12).

13 Claims, 4 Drawing Sheets

ARCHITECTONIC SPACER BUILDING SYSTEM

RELATED APPLICATIONS

This application is a continuation-in-part of PCT international application Ser. No. PCT/MY2009/000203, filed Dec. 4, 2009, designating the United States, which claims the benefit of Malaysan Application No. PI 20097019, filed Oct. 1, 2009. The entire contents of the aforementioned patent applications are incorporated herein by this reference.

FIELD OF INVENTION

The present invention generally relates to a spacer building system and more particularly to an architectonic spacer building system which allows flexibility in form of design and flexibility in assembly of physical building components using pre-cut materials.

BACKGROUND OF INVENTION

Prefabricated or Industrialised Building System (IBS) component has been widely used in the housing construction sector that facilitates mass production. An IBS building uses ingredients like prefabrication, standardisation, methods of production and quality control (Gann, 1996). The engineering advantageous in using IBS in construction include elimination of waste, precision and quality control in production, optimisation of time and sustaining and protecting the environment during construction. These benefits encourage IBS as a construction technique and this factor is one of the prime factors for promoting the IBS building system around the world. Unfortunately, designers still have problem to creatively experiment with IBS components during a building project's design phase and prefabrication.

The level of standardisation and prefabrication process is considered very low (Noguchi, 2003). Despite its premature growth in the construction industry, IBS construction is a preferred construction method in developing countries. The targeted benefit of IBS implementation is its objective to minimise dependency on foreign labour in construction projects. However, IBS implementation meets the supply demand barrier. Economic volume, general readiness and social acceptability of IBS make the construction technology less appealing (Zuhairi 2008). Moreover, although the prefabrication building process puts emphasis on the mass production, repetitive design layout is blamed for causing monotonous barrack-liked complex (Thanoon 2003).

Gib (1999) identified three categories of offsite prefabrication; namely, non-volumetric, volumetric, and modular building, but he argued that the line dividing each type is flexible. When Gib's concepts are applied into prefabricated house design in term of architectural perspective, there is a miss-coordination between the spatial dimensioning of physical building element and the functional building design element therefore making it not appropriately moulded into fabrication of the house's space design. Yet Gib's system also did not address the assembly and disassembly of industrialised building systems. It is also noted that there is no timber building system existing for prefabrication since the conventional wooden construction joints have been used in the prefabrication process. Additionally, there is nil assembly of industrialised building system in the form of non-volumetric pre assembly for volumetric pre assembly and/or modular building.

Schindler was reported attempting to develop new construction system for housing whereby the construction system enables to reduce construction cost, improve in building efficiency, increase speed of fabrication interchangeability of parts, reduce number of labours, provide durability and provide better design (Jon Ho Park 2004). Schindler had identified the needs of building assembly in prefabrication but his construction system was complicated that it reduced prefabrication flexibility of the designed assembly. To date, there is a lack of pre assembly system that is flexible enough to simplify the assembly in prefabricated timber building construction, especially when the assembly system is applicable only in precast concrete panel systems and more so in the less developed timber building assembly.

Historically those taking standardisation seriously have always struggled to resolve the conflict between uniformity and variation, between standardisation and flexibility (Gibb 2004). This conflict still not been solved.

In one of the prior art, it discloses a modular building system which includes a prefabricated desk system having a plurality of rectangular flooring modules. However, the system is modular form but not in the form of building component assembly. Moreover, the floor modules of this prior art are sandwiched with joist and connector.

Another prior art discloses a joint connector device and a method for assembling prefabricated building panels. This prior art invention includes an L-shaped cove channel joint connector device for joining prefabricated structural building panel and its method of assembly. However, it does not have flexibility for angular or radial walls construction.

The invention of this study focused on the design assembly for an industrialised building system in which degree of flexibility in design form can be rejuvenated. This invention stating the prefabricated building assembly is not only an engineering process. It is an amalgamation of both design cum engineering methods and mechanics.

SUMMARY OF INVENTION

The present invention relates to an architectonic spacer building system which allows flexibility in form design and flexibility in the assembly of prefabricated modular components using pre-cut building materials. Accordingly, it relates to physical building components design assembly principle for industrialised building system.

In accordance with preferred embodiments of the present invention, the architectonic spacer building system for skeleton construction which is used for developing design assembly for physical building components in a modular industrialised building system (IBS), characterised in that the architectonic spacer building system includes spacer having predetermined shape for use in constructing modular form of building component; wherein said spacer has a length of at least 0.1 m (100 mm) used to construct modular floor joist assembly, corner and crisscross junctions assembly; and wherein said spacer has a thickness of at least 0.001 m (1 mm); the spacer acts as an anchored dowel connector, composite key roof connector and/or a bracing of adjoining wall panel; and wherein the spacer is used in modular wall panel of a predetermined size to form a "flexi-shape" of angular, radiated wall, or polygonal wall; wherein the spacer is also a piece of physical building assembly component to integrate with various physical building components in prefabrication.

Accordingly, the spacer can be of rectangular, square, triangular or polygonal in shape. The spacer can be a solid, hollowed or extruded form of different shape profile.

Accordingly, the spacer is a floor joist dowel connector, composite key roof connector, a bracing of adjoining and/or intersecting wall panel. The composite key roof connector includes of modular hip rafter, key bracket spacers, key plate spacers and key ties.

It will be appreciated that the spacer is used to attain a required cross section for structural stability in vertical and horizontal physical building components such as floor joist, wall panel, and roof truss formation. Accordingly, the spacer can also be used to extend the length or a connector for making long span horizontal physical building components such as beam or joist.

It will also be appreciated that the spacer can be served as an interlocking jigsaw piece in method of playing with the modular physical building components to knit armature of sub- and super-structure of prefabricated building structures. The spacer also tends to act as a shock absorber for any structural mechanisms of the building such as impact load, lateral movement or floor vibration of the building structure.

Accordingly, the spacer used in modular wall panel creates slit between two sectional building materials while joining at corner or crisscross junction of the wall panel that allow conduit of services to be accommodated thereof.

Accordingly, the spacer can be in multi dimensional shape to form an angular and polygonal wall panel. The spacer can also be develop as principle for flexible assembly of roof, such as pyramid roof, mansard roof (double slope) and cone roof by using the composite key roof connector to hold main rafters to form longer span truss. Said composite key roof connector can easily form a two-tier roofing and cupola on top for admitting light. Utilisation of architectonic spacer building system would save the volume of materials used in prefabricated industrialised building system such as wood, metal, etc.

BRIEF DESCRIPTION OF DRAWINGS

The accompanied drawings constitute part of this specification and include an exemplary or preferred embodiment of the invention, which may be embodied in various forms. It should be understood, however, the disclosed preferred embodiments are merely exemplary of the invention. Each assembly form may be fastened together with a preferred method of fastening such as with nails, screws, caulking, etc. Therefore, the figures disclosed herein are not to be interpreted as limiting, but merely as the basis for the claims and for teaching one skilled in the art of the invention.

In the appended drawings.

DETAILED DESCRIPTION OF PREFERRED EMBODIMENTS

A detailed description of preferred embodiments of the invention is disclosed herein. It should be understood, however, the disclosed preferred embodiments are merely exemplary of the invention, which may be embodied in various forms. Each assembly form may be fastened together with a preferred method of fastening such as with nails, screws, caulking, etc. Therefore, the details disclosed herein are not to be interpreted as limiting, but merely as the basis for the claims and for teaching one skilled in the art of the invention.

Figure 1:
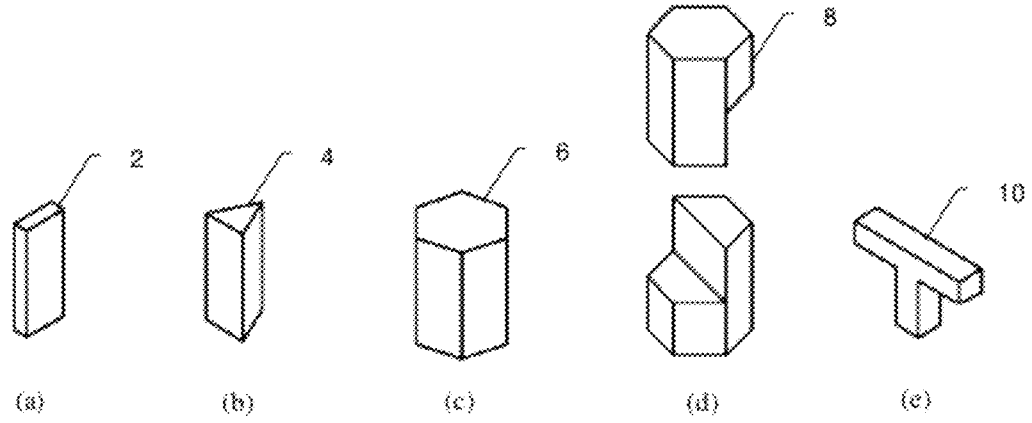
FIGS. 1(*a*)-1(*e*) show various geometrical shapes of spacer and interlocking spacer used in architectonic spacer building system in accordance with preferred embodiment of present invention, and the spacers may be hollowed, solid or extruded in its form.

The invention relates to physical building components design assembly principle for industrialised building system. This system uses various geometrical shapes of spacer such as rectangle, square, triangular or polygon in shape for construction of flexible design form. For instance, FIGS. 1(*a*)-1(*e*) show various possible geometrical shapes of spacer (2, 4, 6, 10) and interlocking spacer (8) used in architectonic spacer building system. The space can be of, but not limited to rectangular, square, triangular or polygonal in shape either as a single part or two separate interlocking parts, depending on the use of the spacer.

Figure 2:
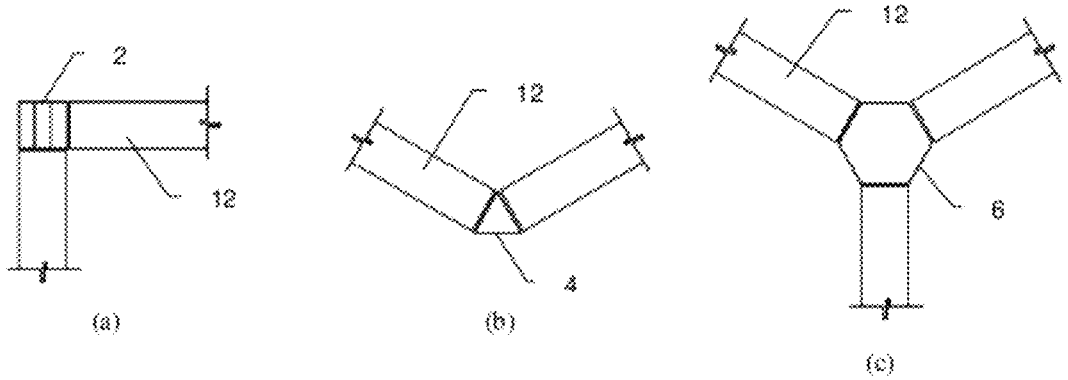
FIGS. 2(*a*)-2(*c*) show the examples of various assemblies of wall panels that are formed by different architectonic spacers, whereby the spacers are used as bracing for adjoining wall panel.
Figure 3:
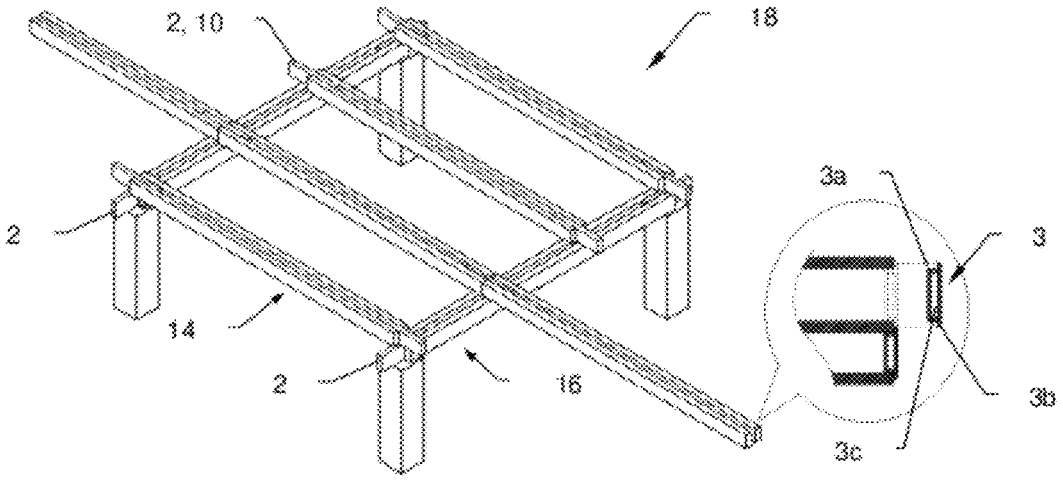
FIG. 3 shows an example of grid modular floor joist assembly, whereby the spacers are used as anchorage dowel connector at upper and lower layers of modular floor joist assembly.

It is to be noted that the spacer works as key accessories in physical building components such as bracing of adjoining wall panel (12), dowel connector (2, 10) and also composite key roof connector (22, 24, 26). FIGS. 2(*a*)-2(*c*) show the examples of various possible assemblies of wall panels that can be formed by different spacers (2, 4, 6), whereby the spacers are used as bracing for adjoining wall panel (12). FIG. 3 shows an example of grid modular floor joist assembly whereby the spacers (2, 10) are used as anchored dowel connector at upper and lower layers (14, 16) of modular floor joist assembly (18).

It is to be noted that the spacer (2) can also be used to form interlocking component or spacer-adjuster (3), by having unequal size of elements (3*a*) configured to form a horn/L-shape lock (3*b*) with predefined depth to interlock both end of modular floor joist. Said interlocking component or spacer-adjuster (3) can be used for floor component assembly of multi-layers. Accordingly, the spacer-adjuster (3) is one of the architectonic forms in modular interlocking component for floor component assembly that is formed by either two or three layer of unequal size of spacer elements joined together with or without slit (3*c*). The purpose of slit (3*c*) in the spacer-adjuster (3) is to increase the depth to hold the joist firmly. It will be appreciated that the spacer-adjuster (3) is an alternative component to ease the assembly of floor components.

Figure 4:
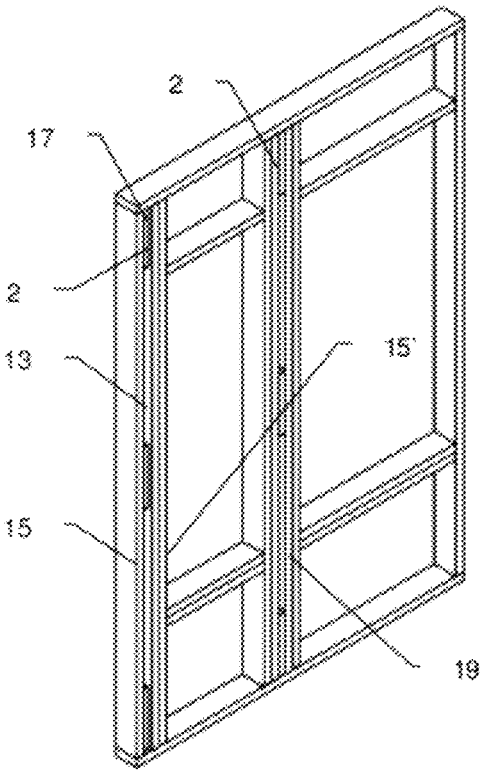
FIG. 4 shows an example of wall panel corner assembly and crisscross junction assembly, whereby the spacers are used to create a corner or wall junction assembly in a prefabrication wall panel.
Figure 5A:
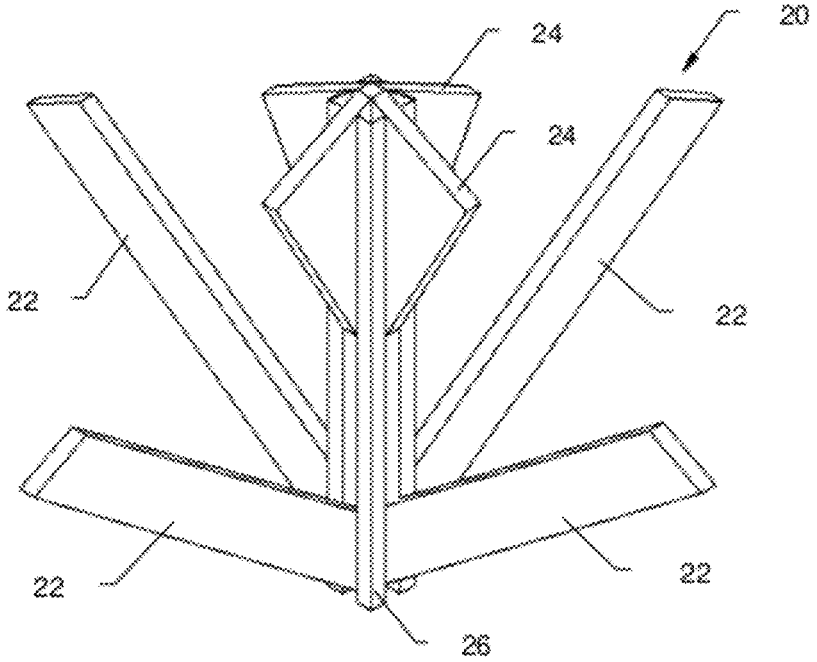
FIGS. 5(*a*)-5(*b*) show the assembly of key roof connector for the pyramid roof, whereby the spacers are used as composite key roof connector.
Figure 5B:
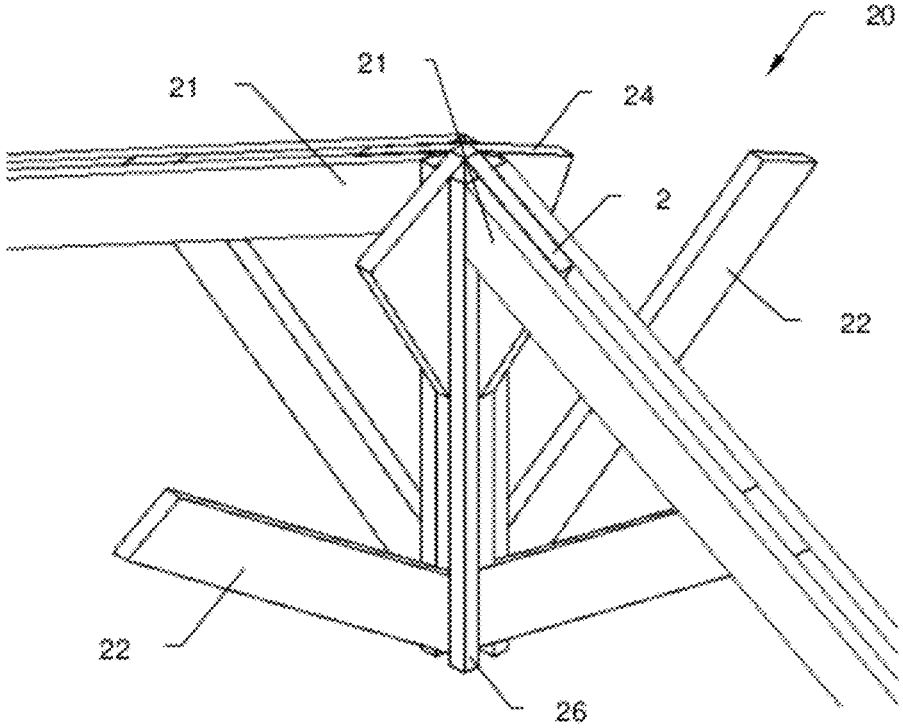
Figure 6A:
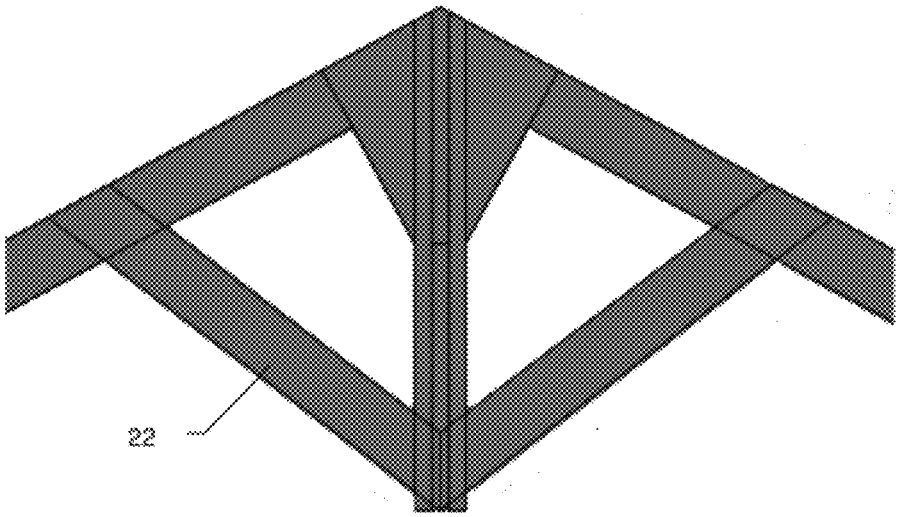
FIGS. 6(*a*)-6(*d*) show physical building components of key roof connector, which includes key bracket spacers, key plate spacers and key ties respectively.
Figure 6B:
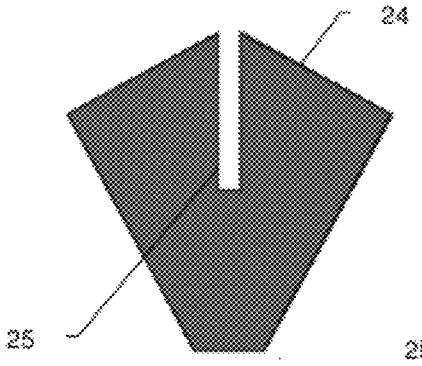
Figure 6C:
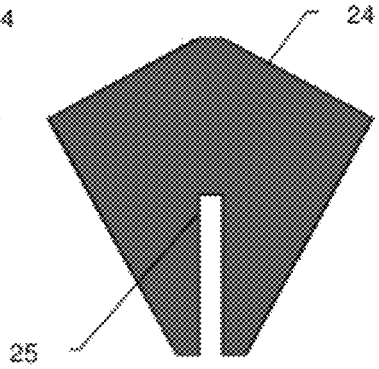
Figure 6D:
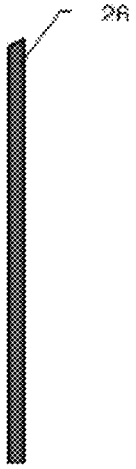

FIG. 4 shows an example of wall panel corner assembly (17) and crisscross junction assembly (19) whereby the spacers (2) are used to create a corner or wall junction assembly in a prefabricated wall panel. FIGS. 5(*a*)-5(*b*) show the assembly of key roof connector for the pyramid roof (20), whereby the spacers (22, 24, 26) are used as composite key roof connector. Accordingly, the physical building components for key roof connector includes key bracket spacers (22), key plate spacers (24) and key ties (26) as respectively shown in FIGS. 6(*a*)-6(*d*).

It will be appreciated that the length of the spacer should not be less then 0.1 m (100 mm) with minimum thickness of at least 0.001 m (1 mm) to make negligible slit for the conduit of services to run in between and also to allow flexible rotation and tolerance for wall panels and roof connection. For spacers interval based on the span, it requires minimum of two spacers for span of 1.8 m (1800 mm) centre to centre of the two spacers. Spacers or anchorage dowels are used to anchor the grid type modular spacer floor joist, wall panel and key roof connector. It will also be appreciated that the spacer can be used to fill up the residual length left over by modular wall panel due to dimensional variation of the functional space. In addition, the spacer also enables to attain a required cross section for structural stability in vertical and horizontal physical building components such as floor joist, wall panel, roof like truss formation, etc. Said spacer added engineering advantage to optimise the use of heavy cross section of building material used in prefabricated building construction.

The spacer can also served as a modular or pre-cut physical building component which can be used as a development length or a connector for making long span of building components such as beam, joist or rafter. Said spacer enables to modularise the physical building components as an assembly parts for easy handling and mobilisation. Preferably, various shapes of the spacer such as rectangle, square, triangular or polygon wherein whose profile can be hollowed, extruded or solid and can be used in modular wall panel of predetermined size, preferably of 1.8 m×2.7 m (1800 mm×2700 mm) to form "flexi-shape" of angular or radiated wall. Accordingly, the spacer can be served as an interlocking jigsaw piece (25) in method of playing with the modular physical building components to knit the armature of sub- and super-structure of prefabricated building structures. The spacer may also tend to act as a shock absorber for any structural mechanisms of the building such as impact load, lateral movement or floor vibration of the building structure. The spacer used in modular wall panel creates slit between two sectional elements while joining at corner or crisscross junction of the wall panel that allow conduit of services to be accommodated thereof.

By the implementation of spacer system, it enables to eliminate complex conventional joints and thus improves the efficiency and precision in constructability. The spacer can be in multi dimensional shape (e.g. triangle, polygon, rectangular and square) to form an angular and polygonal wall panel. Therefore, the degree of flexibility in form of the industrialised building system is increased. The spacer system also develop principle for flexible assembly of roof, such as pyramid roof, mansard roof (double slope) and cone roof by using the composite key roof connector to hold the main rafters and it also can form longer span truss. Moreover, the spacer system for roof principle in the composite key roof connector can easily form a two-tier roofing and cupola on top for admitting light.

To make crisscross junction, radiated walls and angular wall, various shapes of spacers and interlocking spacer can be placed in any angular degree to sides of wall panel. Accordingly, this spacer system helps to provide assembly of the wall panel that obtains appropriate right angle clear corner for mounting any type of cladding. In addition, composite key roof connector which includes of modular hip rafter (21), key bracket spacers (22), key plate spacers (24) are held with four vertical key ties (26) to keep the pyramid roof (20) in intact.

It will be appreciated that, the architectonic spacer building system provides modular assembly system that allows flexibility in design form and flexibility in the assembly of physical building components using pre-cut materials. Architectonic spacer building system supports a design assembly for physical building components in a modular industrialised building system. Accordingly, spacer is a key physical building component for assembly system to integrate the various physical building components in prefabrication and on-site installation, which is termed as architectonic. The architectonic is defined as a blend of organised structure and form in which physical building component are knitted by spacer. The knitting design assemble is the key invention for various physical building component such as grid modular joist, slit wall panel and composite key roof connector.

It will also be appreciated that the architectonic spacer building system is complete pre made assembly of flexible design integrated industrialised building system. In this design assembly system, spacer used as key accessories for various physical building components such as anchorage dowel for floor joist, development length-connector for long span beams, corner and crisscross junction wall panel, unique roof assembly system using long span truss, pyramid roof and their derivatives. The spacer-designed assembly system has not used any complex conventional joints for the assembly and disassembly. The use of spacer system optimises utilisation of materials (such as lumber was reduced by 25%) as compared to conventional prefabrication method such as post and beam. This spacer system lightens the weight of the building. It also claims that in the super structure, one type of cross sectional building material can be used all over, and it achieves required cross section by spacer for the structural stability.

While embodiments of the invention have been illustrated and described, it is not intended that these embodiments illustrate and describe all possible forms of the invention. Rather, the words used in the specification are words of description rather than limitation and various changes may be made without departing from the scope of the invention.

The invention claimed is:

1. An architectonic spacer building system comprising:

a plurality of beams, each beam including a first board layer, a second board layer, and at least one spacer in between the first and second board layer; and a composite key roof connector including two or more of the plurality of beams, wherein the at least one spacer of each beam includes a key plate spacer and a key bracket spacer, the key plate spacer and the key bracket spacer extending from a modular hip rafter at angles relative to one another, wherein the modular hip rafter is oriented vertically, wherein the composite key roof connector further includes at least four spacers configured as key ties, the key ties configured as a bundle and oriented vertically to hold the key plate spacer and the modular hip rafter therebetween at one end of the key ties, and to further hold the key bracket spacers therebetween at another end of the key ties opposite the key plate spacers.

2. The architectonic spacer building system of claim 1, wherein two or more of the plurality of beams is configured as floor beams to construct a modular floor joist assembly with two or more layers of the floor beams assembled in a grid, and each layer of floor beams of the modular floor joist assembly includes at least one spacer acting as an anchored dowel connector.

3. The architectonic spacer building system of claim 1, wherein the at least one spacer is one of a rectangular shape, a square shape, a triangular shape and a polygonal shape.

4. The architectonic spacer building system of claim 1, wherein the spacer is a solid, hollowed or extruded form of different shape profile.

5. The architectonic spacer building system of claim 1, wherein the composite key roof connector is configured for flexible assembly of a roof including a pyramid roof, a mansard roof, and a cone roof by using the composite key roof connector to hold main rafters to form a span truss.

6. The architectonic spacer building system of claim 1, wherein the at least one spacer includes one of a solid form, a hollowed form, and an extruded form.

7. The architectonic spacer building system of claim 1, wherein two or more of the plurality of beams is configured to construct a wall panel corner assembly including at least two of the plurality of beams joined together at an angle relative to one another by a spacer to form a corner junction of two wall panels.

8. The architectonic spacer building system of claim 1, wherein two or more of the plurality of beams is configured to construct a corner assembly including one of the plurality of beams with a board member joined at each end of said beam at an angle thereto.

9. The architectonic spacer building system of claim 8, wherein two or more of the plurality of beams is configured to construct a crisscross junction assembly including two or more of the plurality of beams intersecting one another in a cross to form a wall junction of a wall panel.

10. The architectonic spacer building system of claim 9, wherein the spacer used to form the corner junction is configured as a bracing of adjoining wall panel assemblies.

11. The architectonic spacer building system of claim 9, wherein two or more of the plurality of beams is configured to construct a wall panel assembly including at least two corner assemblies and at least one crisscross junction assembly, wherein at least one end of a beam of the at least one crisscross junction assembly is operatively connected to the board member of the corner assembly.

12. The architectonic spacer building system of claim 11, wherein the at least one spacer of each beam is configured to create a slit between the first and second boards and within the wall panel assembly thereby allowing utility conduits to pass therethrough.

13. The architectonic spacer building system of claim 11, wherein the wall panel assembly is configured as an angular wall, a radiated wall, or a polygonal wall.

* * * * *